United States Patent [19]

Bergman

[11] Patent Number: 4,676,185

[45] Date of Patent: Jun. 30, 1987

[54] FREE FALL ESCAPE VEHICLE AND LAUNCH

[75] Inventor: Gunnar Bergman, Montecito, Calif.

[73] Assignee: Seatek, Goleta, Calif.

[21] Appl. No.: 774,857

[22] Filed: Sep. 10, 1985

Related U.S. Application Data

[63] Continuation of Ser. No. 550,608, Nov. 10, 1983, abandoned.

[51] Int. Cl.[4] ..... B63B 35/00

[52] U.S. Cl. ..... 114/349; 114/348

[58] Field of Search ..... 114/375–378, 114/348–350, 360, 365, 140, 380, 368; 244/138 R; 188/171; 441/1, 6, 22

[56] References Cited

U.S. PATENT DOCUMENTS

| | | | |
|---|---|---|---|
| 1,107,109 | 8/1914 | Powers | 114/376 |
| 1,133,063 | 3/1915 | Sardynski | 114/350 |
| 1,379,788 | 5/1921 | Stone | 114/377 |
| 2,082,202 | 6/1937 | Frankfurt | 114/350 |
| 2,350,344 | 6/1944 | Fraser | 114/375 |
| 2,686,323 | 8/1954 | McCarty | 114/348 |
| 2,714,731 | 8/1955 | Binmore | 114/378 |
| 2,891,262 | 6/1959 | Miller | 114/368 |
| 3,064,282 | 11/1962 | Kangas | 114/349 |
| 3,101,149 | 8/1963 | Hurst | 114/375 |
| 3,747,550 | 7/1973 | Stoebrl | 114/140 |

FOREIGN PATENT DOCUMENTS

| | | | |
|---|---|---|---|
| 1200709 | 7/1970 | United Kingdom | 114/375 |

*Primary Examiner*—Trygve M. Blix
*Assistant Examiner*—C. T. Bartz
*Attorney, Agent, or Firm*—Christie, Parker & Hale

[57] ABSTRACT

A free fall escape vehicle has surfaces of a deceleration structure that decelerate the vehicle upon entry into the water at a rate no greater than 4 g to 10 g by progressively increasing in area towards an escape vessel of the vehicle. In one form, the deceleration structure is circularly symmetrical normal to its axis, which can be approximated by a series of spaced-apart shells, each shell being a zone of a sphere the center of curvature of which is at or above the center of gravity of the escape vehicle; the condition can also be approximated by truncated sections of right circular cones. An escape vehicle similar to a lifeboat has a wedge-shaped deceleration structure with the sides of the wedge paralleling the fore-and-aft axis of the vessel, the structure can be approximated by a series of right circularly cylindrical shells or flat plates both having an effective center of curvature at or above the center of gravity of the vehicle. A double-wedge escape vehicle easily stores and has good control over transverse decelerations. A launch apparatus forces the vehicle to swing by gravity away from the stricken platform or vessel and releases it with the vehicle's vertical axis as nearly parallel as possible to the velocity vector at water entry.

28 Claims, 9 Drawing Figures

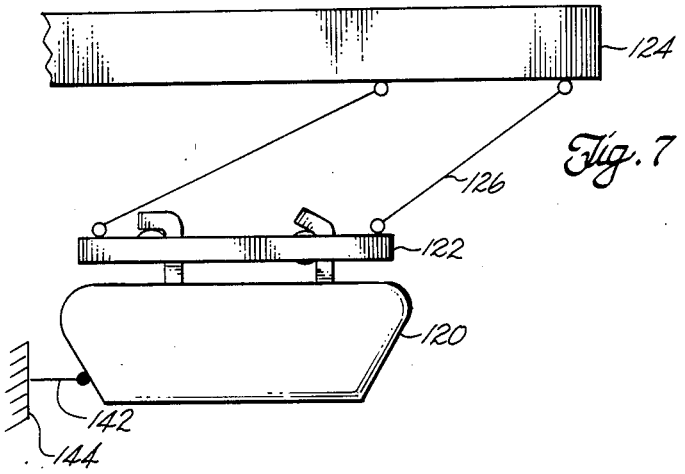
Fig. 7
Fig. 8
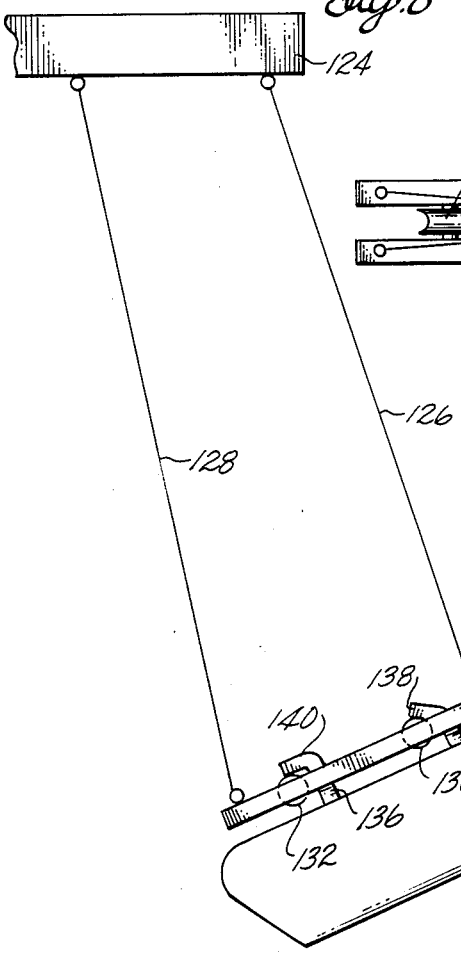
Fig. 9
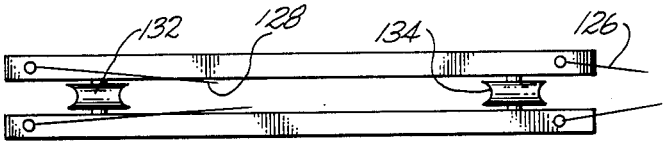

FREE FALL ESCAPE VEHICLE AND LAUNCH

CROSS-REFERENCE TO RELATED APPLICATIONS

This is a continuation of application Ser. No. 550,608, filed Nov. 10, 1983, now abandoned.

BACKGROUND OF THE INVENTION

The present invention relates to lifesaving vehicles for ships and offshore platforms, and in particular to such vehicles that free fall to the water and decelerate from water resistance in a controlled manner.

Escape vehicles used to leave stricken ships and offshore platforms include open lifeboats and enclosed escape capsules.

Typically, lifeboats and escape capsules mount on davits well above water level. Winches control their descent from a stricken vessel or offshore platform to the water. People enter the escape vessels, winches operate to lower the vessels from the stricken ship or platform to the water, and the vessels are released from the winches.

These traditional launching processes and mechanisms have many disadvantages: Quite often it is difficult to operate the davits and winches. The process is time consuming, and time can be critical. The launch mechanism is comparatively complex because of winches and attendant machinery. With this complexity there is possibility in heavy seas that waves will make launching difficult or unsuccessful; for example, waves could prevent proper release of the escape vehicle from the launching mechanism. The davit method places the escape vehicle close to the ship or platform being evacuated, and that can be dangerous because of vessel or platform interference with the path of the lifeboat or escape capsule.

Free falling escape vehicles offer significant advantages over traditional vehicles. They are simple, easy to operate, and can be made to launch free of the ship or platform with a simple launching apparatus. A free falling vehicle may be mounted so that gravity alone effects launch with the release of a restraint. In some instances, however, it may be satisfactory to use davit and winches to launch free falling escape vehicles by lowering the vehicles part of the way and then the vehicles are released to free fall the rest of the way to the water.

Movement away from the ship or platform upon release can be done by pendulously supporting the vehicle to produce a horizontal component of motion upon release.

Free falling escape vehicles, however, must provide controlled deceleration upon entering the water, for the distance that they fall can be considerable, as much as 30 meters for an ocean platform not being an uncommon requirement. The escape vehicle and its occupants falling from even a modest distance without controlled deceleration would be worthless: the occupants would suffer unacceptable injury, the vehicle could be structurally damaged and not seaworthy.

Acceptable rates of deceleration of an escape vehicle entering the water is from between about 4 g to about 10 g. It is also desirable to minimize jerk, that is, the time rate-of-change of acceleration, and so uniform deceleration should occur to the extent practical.

An escape vehicle must be dynamically and statically stable in the water over a broad range of entry angles so that the attitude of the vessel will be correct after the effects of impact with the water are over. A vehicle that because of the angle at which it hits the water rolls over on its side would be totally unacceptable. The angle of entry can be effected by uncontrollable variables such as the state of the sea or the angular orientation of the ship or platform, for example. The vehicle then, must be tolerant of water entry angles. It must have dynamic stability and be able to maintain its correct attitude during the deceleration process; it must have static stability to be able to maintain its correct attitude after the effects of deceleration are gone.

SUMMARY OF THE INVENTION

The present invention provides a free fall launched escape vehicle that has a shape to produce generally uniform deceleration in the water within the range of about 4 g to about 10 g. The vehicle is made up of two general components: a vessel for the occupants of the vehicle and a deceleration structure. The vessel may be an escape capsule or a conventional lifeboat. The deceleration structure presents ever-increasing surface area along the line of entry of the vehicle towards the vessel against which the water acts to decelerate the vehicle.

A general form of the present invention includes the deceleration structure with ever increasing area as the escape vessel is approached which effects deceleration at a controlled rate within the range of 4 g to 10 g from some predetermined height. The deceleration structure has a surface envelope to effect this rate of deceleration. The surface need not be continuous; in fact it is preferred that the surface be generated by stacked, parallel members that have impact surfaces against which the water acts to decelerate the vehicle. The members have a curvature to produce force vectors that pass through or above the center or gravity of the vehicle. The members mount to the vessel through a frame. The members are preferably in member pairs with the members of each pair being spaced apart from each other to present impact surface only close to the lateral outside of the deceleration structure. The spacing generates an open space at the center of the deceleration structure.

In one particular form, the vehicle of the present invention is circularly symmetrical: both the vessel and the deceleration structure. Circular symmetry is about a longitudinal axis that is normal to the water's surface after deceleration and when the vehicle is in repose. The deceleration structure defines an envelope of resistance with a surface area that increases from the entry point to the vessel to effect approximately uniform deceleration within the range of from about 4 g to about 10 g. This envelope may have a continuous surface that takes the general appearance of an inverted bell. It is preferred, however, to approximate this envelope with a series of stacked, spherically surfaced shells that have a center of curvature at or above the center of gravity of the vehicle. The outer boundary of each shell generally falls on the envelope. The spherical curvature and locations of the center of curvature results in pressure forces acting on the deceleration structure from the water that create no moments that tend to capsize the vessel. The spherical curvature can be approximated by right circular cone frustrums; the right circular cone frustrums have different included angles, the included angles becoming increasingly greater from the remote plates that initially strike the water to the plates most proximate the vessel that strike the water last.

An alternate particular form of the present invention has a fore-and-aft length greater than the beam; the vessel for the vehicle's occupants can then be of a generally prolate spheroidal shape. The deceleration structure best suited for a vessel that is long relative to its beam has a surface that defines a wedge-shaped envelope, with an apex of smallest area remote from the vessel and with increasing area progressively to the vessel. Preferably the envelope is approximated by sections of right circular cylindrical shells stacked in spaced array one above the other. Flat plates, in turn, can approximate the right circular cylindrical shells. The envelope should direct pressure forces through the center of gravity, or above it, as in the circularly symmetrical version. The wedge can also be adapted into an inverted, generally "V"-shaped double wedge configuration, again preferably of stacked shells. The double wedge has the advantage of easy storage on deck because of stability produced by the wedges. A double wedge structure can produce closer to ideal decelerations when large entrance angle variations must be considered because the angle of the leading wedge will more closely be aligned with the entrance velocity vector than would the angle of a vertical wedge.

In all versions, it is preferred to abbreviate the impacting surfaces of the shells or plates by eliminating their centers because structure there is not necessary to effect the controlled deceleration and can be eliminated to make the vehicle lighter and less costly.

Preferably, the present invention utilizes a launch mechanism that swings the vehicle away from the platform or vessel with which it is used at the time of launch. This mechanism has attitude adjustment means to force the vehicle to enter the water with the principal axis of the structure parallel to the velocity vector to produce as closely as possible ideal deceleration directions and values. This may be done by having ramp and guide launch with the ramps oriented to produce desired rotation of the vehicle at release from the guides. The guides may be rollers. For example, an aft ramp can be horizontal and a forward ramp can be inclined from the horizontal upwardly so that the vehicle will be released to leave the launch with the bow raised with respect to the horizontal and with an angular velocity to present the vehicle vertical figure axis parallel to the velocity vector at impact with the water.

The present invention provides a free falling escape vehicle with a deceleration structure that effects a controlled deceleration which is essentially uniform between about 4 g to about 10 g. It does this with a structure that is dynamically and statically stable.

These and other features, aspects and advantages of the present invention will become more apparent from the following description, appended claims and drawings.

BRIEF DESCRIPTION OF THE DRAWINGS

FIGS. 7 and 8 show schematically the preferred launch mechanism of the present invention; and FIG. 9 shows in top plan view the launch structure aboard the platform or vessel of the launch mechanism shown in FIG. 7.

DESCRIPTION OF THE PREFERRED EMBODIMENTS

Figure 1:
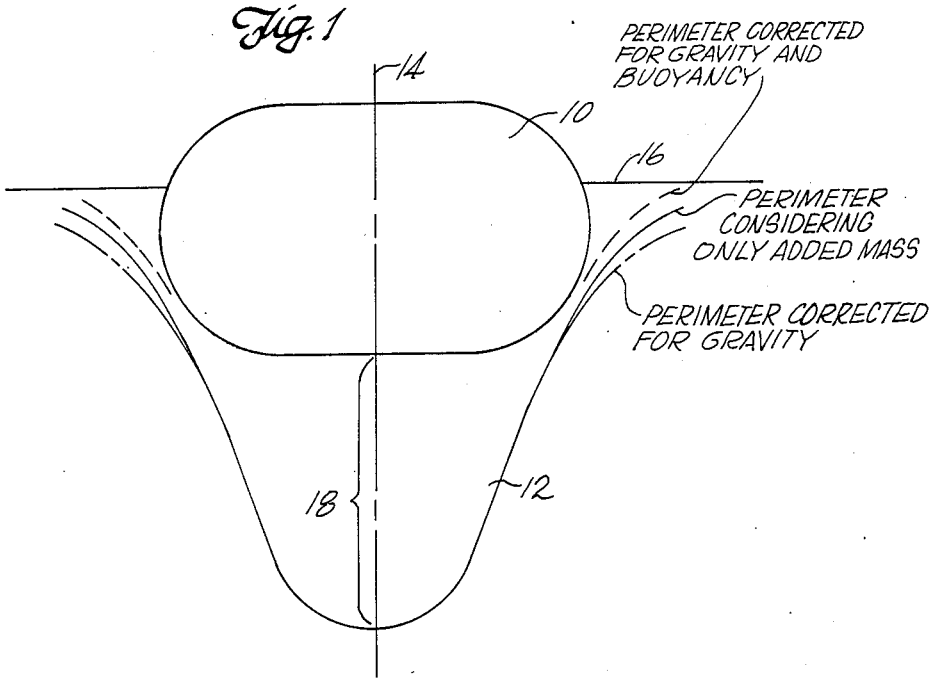
FIG. 1 is an idealized drawing of an escape vehicle that is circularly symmetrical about a vertical axis and has an enclosed occupant vessel and a deceleration structure in the form of an inverted bell.

This invention relates to an escape vehicle that free falls upon launch. It has two major components: an escape vessel for occupants and a deceleration structure. Existing escape vehicles launch by davits or cranes are oblong vehicles and vehicles of nearly circular symmetry. They may be covered or open. This invention can adapt these existing types of escape vehicles to free fall vehicles.

Escape vehicles in use before this invention are not suitable for free fall launch because they cannot sustain the large deceleration forces occurring during water impact. The forces are so large that serious injury to its occupants can be expected at quite modest free fall heights such as three meters, heights much smaller than those that must be used on existing offshore platforms and ships. The forces would also cause the destruction of, or at least severe damage to, the escape vehicle.

For use in an offshore platform, the escape vehicle must be on the main deck. The height of the main deck above water varies considerably from platform-to-platform. Floating platforms may be ballasted to drafts differing by 16 meters or more depending on the operational mode. A range of distances from the main platform deck to the water can be as small as 9 meters to as great as 27 meters. As already stated, even at the low end of this range, escape vehicles without adequate means to control the rate of deceleration could damage the vehicle and injure its occupants.

Escape vehicles must also be safe to launch when the sea state is extremely rough; indeed, this is one of the conditions when launch occurs, the other being fire. The wave condition during a high sea is such that it is impossible to know the attitude of the escape vehicle with respect to the water at the time of impact and the attitude can vary considerably. The vehicle must maintain an upright attitude during deceleration and afterward regardless of the angle of impact and the state of the sea. The attitude of the vehicle with respect to the water at impact can determine whether deceleration of the vehicle will be tolerable. Acceptable angles of impact must be at least 20° from the surface of the water and preferably larger.

Free fall launch systems must permit the vehicle to land far enough away from the platform or ship to eliminate risk of collision with the platform or ship during and immediately after fall. The launch system should release the vehicle such that the vehicle has no angular velocity or only small intended ones and so that the vehicle does not tumble.

The decelerating forces acting on an escape vehicle must be at acceptably low levels and maintained within a satisfactory range of values. The latter requirement avoids "jerk"—the time rate of change of acceleration.

The present invention has deceleration structures that progressively increase in area from an end that initially meets the water towards the vessel so that the water impacts increasingly more structure with time. The deceleration structure results in deceleration values of 4 g to 10 g with vehicle static and dynamic stability.

A deceleration structure of minimum depth is preferred for economy, storage, ease of launch, and seaworthiness.

A right-circular cone-shaped deceleration structure illustrates shape constraint. With a cone, the peak deceleration decreases with decreasing apex angle.

Cones do not produce uniform deceleration. And since deceleration is not uniform, for a given limit of peak deceleration the cone must necessarily be deeper than a shape that produces more uniform deceleration. Accordingly, cones are not the preferred shape for the deceleration structure.

The rate of deceleration of an escape vehicle between its impact velocity and zero velocity depends on three forces due to added mass, gravity, and buoyancy. Of these, added mass is the most significant. Added mass is simply the amount of water effectively moved by the decelerating vehicle. As a first approximation, buoyance forces and gravity forces can be ignored.

A tolerable level is in the range of between about 4 g to about 10 g.

Considering only the added mass and applying the conservation of momentum theorem leads to the following equation:

$$v(t) - \frac{v(t)m(t)}{m(t) + \Delta m} = ng\,\Delta t, \tag{1}$$

where m(t)=the total mass (including added mass), v(t)=the velocity of the vehicle, g=the acceleration of gravity, n=the deceleration in g units, Δt=an increment of time, and Δm=the corresponding increment of total mass.

When, $$\Delta t \rightarrow 0.$$

Equation (1) becomes $$\frac{dm}{dt} = \frac{m(t)}{v(t)}\,ng, \tag{2}$$

But $$v(t) = v_o - ngt, \tag{3}$$

where $v_o$ is the impact velocity. From equations (2) and (3)

$$m(t) = m_o \frac{1}{1 - \frac{ng_t}{v_o}}, \tag{4}$$

where $m_o$ is the mass of the vehicle.

From equation (3), $$S = v_o t - \frac{ngt^2}{2}, \tag{5}$$

where S is the penetration distance. From equations (4) and (5), $$m(t) = \frac{m_o}{\sqrt{1 - \frac{2Sng}{v_o^2}}}, \text{ and } m_a(t) = m(t) - m_o, \tag{6}$$

where $m_a(t)$ is the added mass.

The added mass of a fully submerged sphere is $\frac{2}{3}\pi r^3\rho$, where r=the radius of the sphere, ρ=the density of the fluid.

For a half-submerged sphere, it is $\frac{1}{3}\pi r^3\rho$.

For circular escape vehicles the deceleration structure is better represented by a prolate ellipsoid of revolution with its long axis being axis 14. The added mass is slightly smaller for such a shape and may be assumed to be $0.3\pi r^3\rho$.

The analysis can be improved by using the force of gravity, then the differential equation becomes, $$\frac{dm}{dt} = \frac{m(t)}{d(t)}\left[ng + \frac{m_o}{m(t)}\,g\right]. \tag{7}$$

Further improvements in the momentum equation would include the bouyance force if the deceleration structure were buoyant, but because the preferred deceleration structure is not bouyant, the corrected equation is not presented here. (There is some bouyancy in the deceleration structure until the air has completely escaped from it.)

With reference to FIG. 1, an escape vehicle employing the criteria described is illustrated. In general, it includes an escape capsule 10 with an appended deceleration structure 12. The latter is in the form of a body of revolution, generally in the shape of an inverted bell. The application of the equations just developed results in the shapes shown for the deceleration structure. The perimeter of the deceleration structure is circularly symmetrical about a longitudinal axis 14, this axis is on the vertical when the vehicle is flaoting in a calm sea. The shape of the structure is asymptotic to plane 16. Plane 16 is the maximum depth the vehicle sinks to during deceleration, and parallels and may be spaced above the sea surface. The perimeters for only added mass, for added mass corrected for gravity, and for added mass corrected for gravity and bouyancy are shown. At the base or entry end of the deceleration structure all three perimeters fall on the same curve. The curves vary as they approach asymptotic plane 16, as indicated in the figure.

The perimeter for just added mass falls between the perimeter for the other two, as one would expect intuitively: gravity tends to force the vehicle further into the water, bouyancy tends to force the vehicle in the opposite direction, and so the perimeter required to produce a limited maximum deceleration must present more surface area when considering only added mass and gravity than when considering added mass, bouyancy, and gravity. In other words, when bouyancy is considered to limit the deceleration to a prescribed maximum, it is necessary to provide less resistance. The perimeters also show that as the vehicle gets deeper and deeper into the water it takes more and more area to produce the same deceleration.

A specific example of an escape vehicle about five meters in maximum diameter, having a mass of 4.8 metric tons, a maximum deceleration of 4 g, and a free fall distance of 14.6 meters has a depth of the deceleration structure of $3\frac{2}{3}$ meters, the depth being indicated by reference numeral 18.

Figure 2:
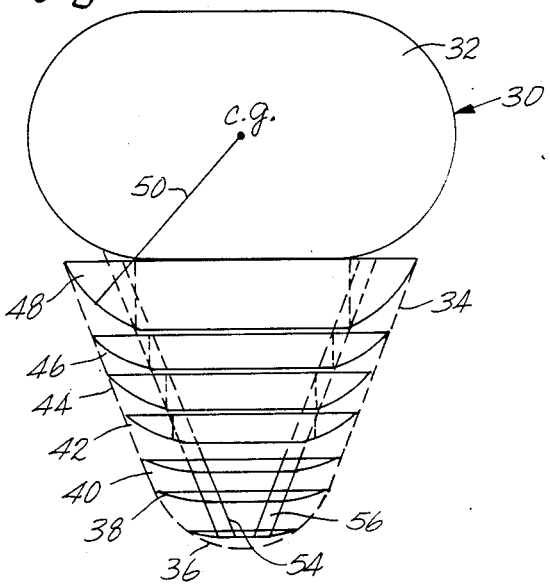
FIG. 2 is an elevation of the presently preferred circularly symmetrical escape vehicle, and is similar to FIG. 1, but with the deceleration structure formed of a series of stacked, spherically curved shells with the center of curvature of each shell at or above the center of gravity of the vehicle.

As indicated in FIG. 2, the flare for all profiles approaches infinity as the plane of maximum penetration is approached. For practical reasons the flare is cut short of that and the desired uniform rate of deceleration is somewhat effected towards the end of the deceleration event.

The result of this accommodation with reality is the deceleration level becomes lower towards the end of the deceleration process and the vehicle penetration depth becomes greater.

Obviously, the escape vehicle must float upright in stable equilibrium after deceleration. The geometry of the vehicle shown in FIG. 1 has a deceleration structure much too deep for that if it were bouyant. To get stable equilibrium at proper orientation, it would be necessary to heavily ballast the deceleration structure at its bottom.

Perforation of the walls of the deceleration structure corrects the static stability problem by permitting rapid flooding of the interior of the device while it enters the water.

The attitude of the vehicle at impact relative to the surface of the sea at impact only roughly can be controlled because of surface swells and waves. If the vehicle with the deceleration structure FIG. 1 is misaligned at the time of impact in the sense that axis 14, the velocity vector at impact, and the normal to the sea surface at the point of impact are not parallel, then misalignment will grow worse, the device will then fall over on its side with disastrous consequences.

This dynamic stability problem can be solved by directing all impact forces at or above the center of gravity of the vehicle. The resistance forces of the water on the vehicle are overwhelmingly of the pressure type. As such, the forces act in a direction normal to the surface elements of the deceleration structure. This surface configuration of the deceleration structure is important because the angle of impact with the sea surface can vary significantly because of the sea surface changes with passing of swells and waves. Consequently, the resultant of the forces in general will pass through different points along axis 14. But if all the forces acting on the structure pass through or above the center of gravity, there will be vehicle stability because the resultant of these forces will pass through or above the center of gravity. These forces act along lines that go through the center of gravity of the vehicle and no torque will be generated that tends to change the attitude of the device. If the forces go above the center of gravity, there will be a correcting torque which, if not too large, is desirable, and the vehicle will be all the more stable.

These considerations have been embodied in the vehicle shown at 30 in FIG. 2. There, a vessel 32 of circular symmetry about a vertical axis mounts a deceleration structure 34 below it. This structure has stacked shells 36 through 48. The surfaces of these shells against which the ocean acts during impact are spherical and the center of curvature of each of these spherical surfaces is at the center of gravity, as indicated by arrow 50 from the center of gravity (c.g.) of the entire vehicle to surface 48. Moving the centers of curvature of the spherical shells above the center of gravity effects a corrective torque that reduces any initial misalignment. The maximum diameter of these shells falls along the envelops developed in FIG. 1 and indicated in phantom in FIG. 2. The shells can be formed as spherical zones inasmuch as the middle of the shells would contribute little to deceleration except for bottom shell 36 which must be continuous from side-to-side. In FIG. 2, struts 54 and 56 tie all of the spherical curved shells together and connect them as a unit to vessel 30.

The structure of FIG. 2 solves the static and dynamic stability problems by permitting the rapid flooding of the interior of the deceleration structure and the elimination of torques that would tend to capsize the vehicle when less than optimum impact angles occur.

The spherical shells of FIG. 2 can be approximated by sections of truncated right circular cones, conical frustrums, that have their outside surfaces such that the pressure forces of the water during impact acting on them pass at or above the center of gravity of the vehicle.

Figure 3:
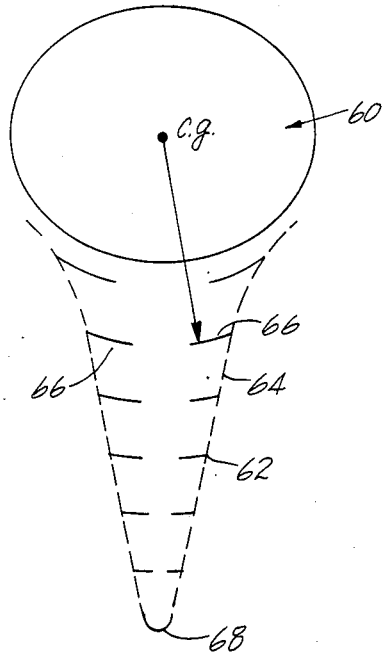
FIG. 3 is an end view of a preferred form of the present invention used with oblong vessels, showing a series of stacked, right-cylindrically curved shells for the deceleration structure with the center of curvature of the shells at or above the center of gravity of the vehicle.
Figure 4:
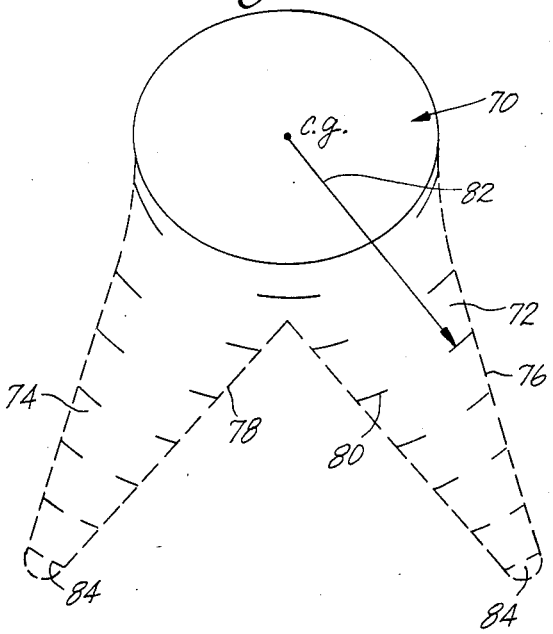
FIG. 4 is an adaption of the FIG. 3 embodiment to produce two "V"-shaped wedges paralleling the fore-and-aft direction.

FIGS. 3 and 4 show the adaption of the concepts of the present invention to oblong escape vessels. In FIG. 3, a closed escape vessel 60 mounts a deceleration structure 62, the envelope surface of which, indicated at 64, extends parallel to the fore-and-aft axis of the vehicle; it is thus wedge shaped. It is preferred to use a plurality of spaced-apart deceleration shells having right circular cylindrical curvature. Again the shells need not be continuous across the path of water entry, their presence proximate the envelope being sufficient. In FIG. 3, a pair of such shells 66 is expressly called out by reference number. Shells 66 extend to the bounding envelope from a short distance within the envelope. Their interior terminii lie about where effective resistance by the water ceases. As before, then, the shells present a hollow interior to lighten the structure. The center of curvature of the shells is at or above the center of gravity of the vehicle for the same reasons presented earlier.

In FIG. 4 the principles just described with reference to FIG. 3 and the earlier figures are applied except in this case there are two distinct deceleration structures. The escape vessel is indicated by reference numeral 70 and it has depending deceleration structures 72 and 74 that are at an acute angle to each other. The deceleration structures are wedge-like, that is, they extend fore and aft along the length of the vehicle for some distance with the envelope surface 76 and 78 paralleling the fore-and-aft axis of the vehicle. Each of the deceleration structures has a series of seven stacked pairs of right cylindrically curved shells. A typical pair of such shells for deceleration structure 76 has a common radius of curvature 82 that passes through the center of gravity of the vessel, but again can pass above it. All the shell pairs have the same characteristic center of curvature, but obviously different radii of curvature. The bottom plate 84 is closed, as in FIG. 3.

Figure 5:
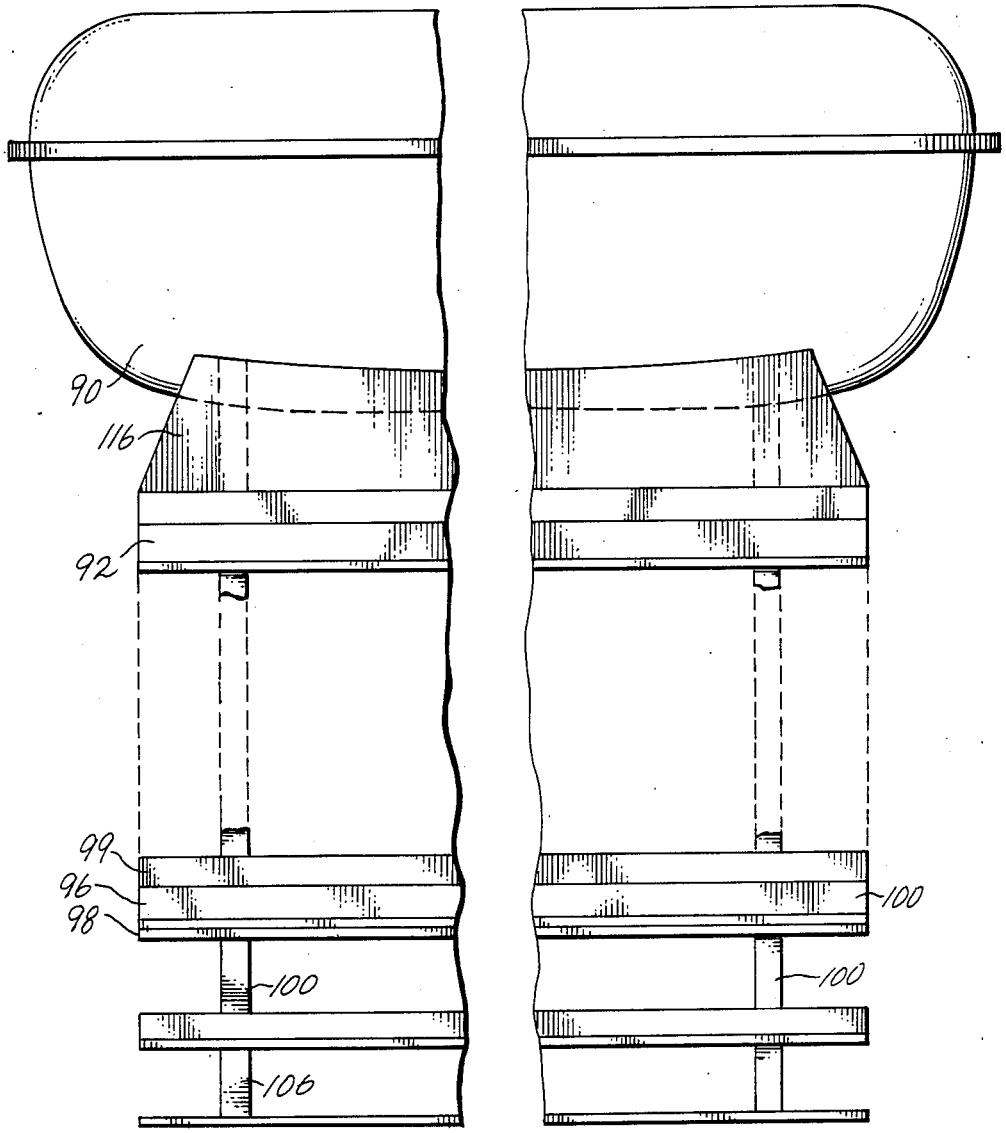
FIG. 5 is a partial side elevation view of an escape vehicle that utilizes a series of stacked, flat plates approximating right-cylindrical surfaces having a center of curvature at or above the center of gravity of the vehicle.
Figure 6:
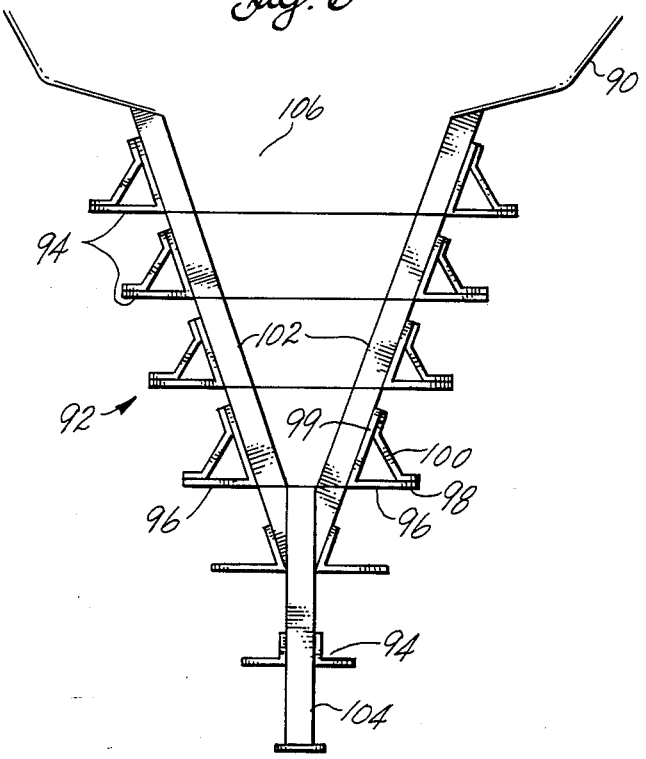
FIG. 6 shows the escape vehicle of FIG. 5 in end elevation.

FIGS. 5 and 6 illustrate in greater detail an approximation to the "oblong" configuration of FIG. 3. Here, an escape vessel 90 mounts a deceleration structure 92. The structure has a stack of flat plates 94 for decelerating the vehicle. Typical of these are plate pairs 96. Each member of the pair has a horizontal impact plate 98 extending outwardly from an upward angulated flange 99, the two being integral and being formed by bending a common piece of metal. A gusset 100 spans between impact plate 98 and flange 99 and attaches to them as by welding to reinforce the impact plate. Struts 102 extend from vessel 90 downwardly in a "V" to meet at a vertical center strut 104 and form a "Y"-shaped frame. The impact plates attach to the struts 102 and 104 at regular intervals as by welding. Plates 94 along strut 104 have increasing horizontal dimension from the bottom of the strut towards the vessel. The envelope defined by the ends of the plates is again wedge shaped. Stringers 106 periodically along the length of the structure provide stiffness and strength.

The flat plate configuration of FIGS. 5 and 6 have the impact forces directed parallel to the vertical symmetrical plane. The impact forces acting on the "V" shaped frame pass below the center of gravity of the vehicle. Such a design offers advantage of simplicity of fabrication and also leads to moderate correcting moments in cases of misalignment about the roll axis at impact. As seen in FIG. 5, fore-and-aft reinforcing gussets 116 extend between vessel 90 and the uppermost of plates 92 to strengthen the strut framework.

FIGS. 7 through 9 show a preferred launching system for the vehicle of the present invention.

The launch apparatus of the invention swings the vehicle away from the vessel or platform being evacuated, and imparts to the vehicle an angular velocity that rotates the vehicle through an angle so that when it impacts the water the vehicle will be horizontal.

Here, a vehicle 120 consisting of both the deceleration structure and the vessel is carried by a carriage 122, which in turn is attached to a horizontal beam 124 through a sling of fore-and-aft cable pairs 126 and 128. These cables attach to carriage 122 and beam 124 with the attachment points being closer at the beam 124 than at the carriage for dynamic stability. The carriage has a fore roller 130 and an aft roller 132. Vehicle 120 has a forward track 134 and an aft track 136. Both tracks are curved. But the forward track is curved with a section 138 at an acute angle to the horizontal; the aft track is curved with a horizontal section 140. A release line 142 attaches to vessel or platform 144 and can be released from within the vehicle 120.

Upon release, the carriage, the sling and the vehicle swing pendulously outwardly and away from the ship or platform, as shown in FIG. 7. The inertia of the vehicle causes it to track on the rollers of the carriage. Because of the inclination of angled section 138 of the forward track and the horizontal section of the aft track, the vehicle will rotate downward with respect to carriage 122 as it leaves the carriage and begins its free fall.

The inclination of track 138 results in vehicle 120 having an angular velocity in the clockwise direction as it leaves the carriage. The angular velocity is such that the vertical figure axis of the vehicle will be as nearly as possible parallel to the velocity vector upon impact with the water. The angular velocity is needed because the velocity vector of the vehicle changes direction, becoming more nearly vertical during the fall.

FIG. 8 shows carriage 122 in greater detail. Rollers 132 and 134 may be supported by axles between a pair of parallel beams. The sling of cables 126 and 128 may be parallel pairs of cables that attach to each of the parallel beams and converge towards their point of attachment at beam 124.

Actual tests of models of the vehicles show that with the shell or plate array, as opposed to a continuous surface, deceleration peaks occur as successive shells or plates strike the water, and so the deceleration rate is not constant. But the variation in rate is acceptable. Also it was observed that the deceleration rate immediately at impact was higher than later but that the deceleration was maintained between 4 g and 10 g over considerable heights. Tests showed that a vehicle without the deceleration structure with a three meter drop experienced 24 g deceleration over a period of about 1/100th of a second. In comparing this result with the results of vehicles with various forms of deceleration structure as taught by this specification, the initial deceleration of the vessel without the deceleration structure was 2.5 times higher for a free fall distance of one one-fifth as much.

U.S. Air Force Specification MIL-S-9479B describes an index for assessing the risk of damage to an occupant of the vehicle and this specification should be consulted in connection with the utilization of this invention.

The deceleration device will affect seaworthiness in several ways. The motion characteristics of the vehicles will undoubtedly be very much improved; rolling motion will become much gentler and the danger of capsizing eliminated. On the other hand, the presence of the structure produces considerable drag. If the latter is important, means should be provided to jettison the deceleration structure, and that can readily be done.

The present invention has been described in reference to preferred embodiments. The spirit and scope of the appended claims should not, however, necessarily be limited to the foregoing description.

What is claimed is:

1. A launch and an escape vehicle for use on ships and off-shore platforms in evacuating personnel from them in emergencies comprising:

a. an escape vessel for the personnel;

b. a non-buoyant deceleration structure depending downward from the escape vessel and defining an envelope of progressively increasing impact area for impacting the water after free fall, the area increasing from an end remote from the vessel towards the vessel, the change of area with distance of the envelope from the end of the envelope remote from the escape vessel being such that the vehicle decelerates from the resistance of water after entrance into the water after falling from a predetermined free fall height above the water, the deceleration being at a rate no greater than from about 4 g to about 10 g, the deceleration structure having a hollow interior and passage means through the envelope for rapid flooding of the interior, the curvature of the envelope being such that substantially all of the impact forces on the envelope from impacting the water are directed at or above the center of gravity of the vehicle;

c. a carriage above the vessel having fore and aft guide means;

d. sling means supporting the carriage from the ship or platform to develop pendulous movement of the vehicle upon release from the stored position and a horizontal component of motion of the vehicle at launch; and e. fore and aft tracks of the vessel engaging the guide means to vertically support the vessel from the carriage in a stored position, the forward track being inclined at an angle with respect to the aft track such that with travel of the tracks on the guides an angular velocity is imparted to the vessel sufficient to rotate the vessel so that its vertical axis as viewed at rest in a calm sea approaches parallelism with the velocity vector when the vehicle impacts the water.

2. The launch and escape vehicle claimed in claim 1 wherein the deceleration structure includes a plurality of stacked and spaced apart members with each member having a surface to impact the water, the members extending inwardly toward the center of the structure and terminating with lateral spacing between transversely adjacent members so that the center of the structure is open, and frame means for connecting the members to the vessel.

3. The launch and escape vehicle claimed in claim 2 wherein the envelope is shaped like an inverted bell.

4. The launch and escape vehicle claimed in claim 3 wherein the escape vessel and the deceleration structure are circularly symmetrical about an axis corresponding to the vertical axis of the vehicle when it is at rest in a calm sea.

5. The launch and escape vehicle claimed in claim 4 wherein the members are spherically curved.

6. The launch and escape vehicle claimed in claim 4 wherein the members are conical frustrums.

7. The launch and escape vehicle claimed in claim 2 wherein the escape vessel and the deceleration structure have a fore-and-aft length greater than their beam, and the envelope is shaped like a wedge with the outer sides of the wedge paralleling the fore-and-aft axis of the vehicle.

8. the launch and escape vehicle claimed in claim 7 wherein the members are right circular cylindrically curved.

9. The launch and escape vehicle claimed in claim 7 wherein there are two of the deceleration structures of the defined wedge shape arrayed in an inverted "V".

10. A free fall escape vehicle for use on ships and offshore platforms comprising:

a. an escape vessel for occupants of the vehicle;

b. a non-bouyant deceleration structure depending downward from the escape vessel and defining a wedged shape envelope having an impact area for impacting the water that progressively increases from an end remote from the escape vessel to the escape vessel, the deceleration structure having a hollow interior and passage means through the envelope for rapid flooding of the interior while the structure enters the water;

c. the change of area of the envelope with distance from the end of the envelope remote from the escape vessel being such that the vehicle decelerates from the resistance of water after entrance of the deceleration structure into the water after the vehicle falls from a predetermined free fall height above the water, the deceleration being no more than about 4 g to about 10 g; and d. the center of curvature of the envelope being such that substantially all of the impact forces on the envelope from impacting the water are directed at or above the center of gravity of the vehicle.

11. The escape vehicle claimed in claim 10 wherein the impact area of the deceleration structure includes a plurality of stacked, concentric members spaced apart from each other.

12. The escape vehicle claimed in claim 11 wherein the center of curvature in transverse cross-section of the members is at or above the center of gravity of the vehicle.

13. The escape vehicle claimed in claim 11 wherein the members have right circular cylindrical curvature.

14. The escape vehicle claimed in claim 11 wherein the escape vessel and the deceleration structure have a fore-to-aft length greater than their beam and the deceleration structure envelope is wedge shaped with the outer sides of the wedge paralleling the fore-and-aft axis of the vehicle.

15. The escape vehicle claimed in claim 14 wherein there are two of the deceleration structures of the defined wedge shape arrayed in an inverted "V".

16. A free fall escape vehicle for use in evacuating ships and off-shore platforms comprising:

a. an escape vessel for occupants of the vehicle;

b. a non-buoyant deceleration structure depending downward from the escape vessel, the decleration structure (i) defining an envelope of progressively increasing impact area for impacting the water after free fall, the impact area increasing from an end remote from the vessel towards the vessel;

(ii) including a plurality of stacked and spaced apart members with each member having a surface to impact the water and with spacing between members providing a passage for water to rapidly flood the interior of the deceleration structure, the members extending inwardly toward the center of the deceleration structure to termini spaced from the center so that the central volume of the deceleration structure is open, and (iii) having frame means for connecting the members to the escape vessel;

c. the rate of increase of impact area from an end remote from the vessel towards the vessel being such that from a predetermined free fall height the rate of deceleration of the vehicle is no more than from about 4 g to about 10 g; and d. the curvature of the members being such that substantially all the impact forces on the envelope from impacting the water are directed at or above the center of gravity of the vehicle.

17. The free fall escape vehicle claimed in claim 16 wherein the envelope is shaped like an inverted bell.

18. The free fall escape vessel claimed in claim 17 wherein the escape vessel and the deceleration structure are circularly symmetrical about an axis corresponding to the vertical axiss of the vehicle when it is at rest in a calm sea.

19. The free fall escape vehicle claimed in claim 18 wherein the members are spherically curved.

20. The free fall escape vehicle claimed in claim 18 wherein the members are conical frustrums.

21. The free fall escape vehicle claimed in claim 16 wherein the escape vessel and the deceleration structure have a fore-to-aft length greater than their beam, and the envelope is shaped like a wedge with the outer sides of the wedge paralleling the fore-and-aft axis of the vehicle.

22. The free fall escape vessel claimed in claim 21 wherein the members are right circular cylindrically curved.

23. The free fall escape vessel claimed in claim 21 wherein the members are flat.

24. A free fall escape vehicle for use on ships and off-shore platforms comprising:

a. an escape vessel for occupants of the vehicle;

a non-bouyant deceleration structure depending downward from the escape vessel and defining an inverted, bell shaped envelope having an impact area increasing from an end remote from the escape vessel to the escape vessel, the deceleration structure having a hollow interior and passage means through the envelope for rapid flooding of the interior while the structure enters the water;

c. the change of area of the envelope with distance from the end of the envelope remote from the escape vessel being such that the vehicle decelerates from the resistance of water after entrance of the deceleration structure into the water after the vehicle falls from a predetermined free fall height above the water, the deceleration being no more than about 4 g to about 10 g; and d. the curvature of the envelope being such that substantially all of the impact forces on the envelope from impacting the water are directed at or above the center of gravity of the vehicle.

25. The escape vehicle claimed in claim 24 wherein the impact area of the deceleration structure includes a plurality of stacked, concentric members spaced apart from each other.

26. The escape vehicle claimed in claim 25 wherein the members have spherical curvature.

27. The escape vehicle claimed in claim 25 wherein the impact area of the members has the curvature of a conical frustrum.

28. The escape vehicle claimed in claim 25 wherein the escape vessel and the deceleration structure are circularly symmetrical about an axis corresponding to the vertical axis of the vehicle when at rest in a calm sea.

* * * * *

UNITED STATES PATENT AND TRADEMARK OFFICE

CERTIFICATE OF CORRECTION

PATENT NO. : 4,676,185

DATED : JUNE 30, 1987

INVENTOR(S) : GUNNAR BERGMAN

It is certified that error appears in the above-identified patent and that said Letters Patent is hereby corrected as shown below:

IN THE SPECIFICATION

Column 6, line 54, change "flaoting" to -- floating --

Column 10, line 22, after "distance of" delete "one"

IN THE CLAIMS

Column 11, line 35, change "fore-and-aft" to --fore-to-aft --

Column 11, line 39, at the beginning of the sentence change "the" to -- The --

Column 11, line 45, change "offshore" to -- off-shore --

UNITED STATES PATENT AND TRADEMARK OFFICE

CERTIFICATE OF CORRECTION

PATENT NO. : 4,676,185

DATED : JUNE 30, 1987

INVENTOR(S) : GUNNAR BERGMAN

It is certified that error appears in the above-identified patent and that said Letters Patent is hereby corrected as shown below:

Column 12, line 24, change "decleration" to -- deceleration --

Column 12, line 57, change "axiss" to -- axis --

Signed and Sealed this

Thirty-first Day of May, 1988

*Attest:*

*Attesting Officer*

DONALD J. QUIGG

*Commissioner of Patents and Trademarks*